US005858025A

United States Patent [19]

Batty

[11] Patent Number: 5,858,025

[45] Date of Patent: Jan. 12, 1999

[54] LIQUID COMPOSITIONS CONTAINING BINDERS AND METHODS OF USING THEM

[75] Inventor: Norman Stewart Batty, West Yorkshire, England

[73] Assignee: Allied Colloids Limited, West Yorkshire, England

[21] Appl. No.: 832,768

[22] Filed: Apr. 4, 1997

[30] Foreign Application Priority Data

Apr. 4, 1996 [GB] United Kingdom ..... 9607111

[51] Int. Cl.[6] ..... D06P 1/44; D06P 1/52

[52] U.S. Cl. ..... 8/445; 8/555; 8/557; 8/637.1

[58] Field of Search ..... 8/445, 557, 558, 8/555, 561

[56] References Cited

U.S. PATENT DOCUMENTS 3,878,151 4/1975 Dachs et al. ..... 8/551

FOREIGN PATENT DOCUMENTS

| | | | |
|---|---|---|---|
| 2014693 | 10/1990 | Canada | C08F 222/04 |
| 2015044 | 10/1990 | Canada | C08G 59/00 |
| 0 393 446 | 10/1990 | European Pat. Off. | C08F 246/00 |
| 0 394 761 | 10/1990 | European Pat. Off. | C08F 246/00 |
| 53-31214 | 12/1993 | Japan | B01F 17/52 |
| 86/01519 | 3/1986 | WIPO | C08F 220/18 |

*Primary Examiner*—Margaret Einsmann

[57] ABSTRACT

A print paste composition contains, as binder, a curable polymer which is free of N-methylol groups and which contains anhydride-forming dicarboxylic acid and/or dicarboxylic anhydride groups which can react with hydroxyl groups in the cotton or other textile substrate and/or with hydoxyl or epoxy groups in the curable polymer.

12 Claims, No Drawings

LIQUID COMPOSITIONS CONTAINING BINDERS AND METHODS OF USING THEM

This invention relates to liquid compositions containing binders and which are print paste compositions comprising a dispersion of a pigment in an aqueous vehicle containing a curable binder. The invention also relates to methods of printing substrates such as textiles with the print paste composition whereby improved bonding of the pigment to the substrate is achieved compared to known systems.

There have been many proposals in the literature for curing polymers in situ after applying a coating of the polymer to a substrate. Some of the coatings are applied non-aqueous and others aqueous. Examples of curable binder systems are to be found in CA-A-2,014,693 and 2,015,044, JP-A-0533121, EP-A-264,896, EP-A-393,446 and EP-A-394,761 and WO86/01519.

None of these are specifically concerned with the problem of achieving a pigment print on a textile or other suitable substrate wherein the print is resistant to washing, scrubbing and rubbing and yet which does not impart a harsh handle to the substrate to which the print is applied.

It is standard practice to print a textile with a textile print paste which comprises a dispersion of pigment in an aqueous vehicle which contains viscosifier and a binder and, optionally, other materials such as cross-linking agents and softeners. The binder is intended to form on the textile a film which does not make the textile have a harsh handle but does give a secure bond of the pigment to the fibres so that the colour is fast and withstands influences such as washing, scrubbing and wet or dry rubbing.

It is necessary that the binder should cross-link after application as otherwise the coating will be inadequately fast. Conventional binders are acrylic polymers including a latent cross-linkable group that will cross-link as a result of heating after application and drying onto the textile so as to form a reticulated structure.

The latent cross-linkable group is usually a reaction product of formaldehyde, in particular N-methylol acrylamide. On drying and curing, for example, for 4 minutes at 150° C. in acid conditions, these groups condense, with themselves and/or with functional groups such as OH groups in cellulosic fibres, to form stable cross-links. However, the reaction never goes to completion and there is always a certain amount of unreacted N-methylol groups left after the heat treatment. These groups can dissociate to regenerate formaldehyde. The result is that there is always a measurable concentration of formaldehyde on fabrics that have been printed with binders or cross-linkers that contain groups derived from formaldehyde. This is undesirable.

It would be desirable to be able to provide a liquid coating composition containing a binder which could be cured onto a substrate utilising convenient curing conditions and yet which avoids the presence of formaldehyde. In particular, it would be desirable to provide a textile print paste which can give a print which is fast and yet has good handle and does not involve the use of formaldehyde.

A print paste composition according to the invention comprises a dispersion of pigment in an aqueous vehicle containing non-binder polymer and curable binder polymer, and the curable binder polymer is generally introduced into the composition as an emulsion in water (and thus is an emulsion in the aqueous vehicle) and is a curable, water insoluble, polymer which is free of N-methylol groups and which is formed of ethylenically unsaturated monomers which are free of N-methylol groups and which comprise (a) anhydride-forming dicarboyxlic acid and/or dicarboxylic anhydride monomer and (b) unreactive water insoluble monomer.

A method of textile printing comprises printing the defined composition on to a textile substrate and heating the printed substrate sufficient to cause (a) reaction between the dicarboxylic acid or anhydride groups and hydroxyl groups in the substrate and/or (b) internal esterification between the dicarboxylic acid or anhydride groups and hydroxyl or epoxy groups in the curable polymer.

The textile substrate preferably includes cellulosic fibres, especially cotton fibres, and the heating preferably causes reaction between the dicarboxylic acid or anhydride groups and hydroxyl groups in the cotton or other cellulosic fibres.

The curable polymer binder must be free of N-methylol groups as otherwise it incurs the disadvantages of the known systems that rely upon curing of methylol polymers, as discussed above.

The curable binder polymer in the invention is a polymer which has been formed by polymerisation of acrylic or other ethylenically unsaturated monomers including a particular type of dicarboxylic acid or anhydride.

It is possible to form the polymer under anhydrous conditions in which event the polymer can initially contain dicarboxylic anhydride groups. However, even if the polymer is initially made in anhydride form, these groups will normally hydrolyse in the aqueous print paste (or in earlier processing steps) so as to be wholly or mainly in the form of acid groups (either free acid or water soluble salt).

Generally therefore the polymer contains dicarboxylic acid groups. It is necessary that these should be anhydride-forming dicarboxylic acid groups since we believe that the transient formation of anhydride groups during the drying and heating of the printed substrate is involved in the formation of the good bond that is achieved in the invention. Thus, anhydride-forming dicarboxylic acid polymers are those in which dicarboxylic anhydride groups can be formed by heating a coating of the composition containing the polymer. Naturally the heating should be under conditions similar to those to which the print will be subjected.

In order that the dicarboxylic acid groups can form the anhydride groups upon heating, it is necessary both that there should be a chain of either two or three carbons between the carboxylic groups (so that a 5 or 6 membered anhydride ring can be formed) and that the steric arrangement of the two carboxylic acid groups is such that an anhydride can be formed. For instance polymerisation of maleic acid is unsuitable as the steric arrangement of the carboxylic acid groups in the resultant polymer will be such that little or no anhydride formation can occur. However anhydrous polymerisation of maleic anhydride, optionally followed by hydrolysis of the maleic anhydride polymer, can be suitable since the anhydrous polymerisation of maleic anhydride results in the required configuration of carboxylic groups in the polymer.

The preferred dicarboxylic monomer for use in the invention is itaconic acid.

The amount of the defined dicarboxylic monomer in the polymer is generally less than 50% by weight and usually less than 20% by weight of the monomers used for forming the polymer. Satisfactory results are generally obtained with 0.1 to 10% by weight, often around 1 or 2% up to around 5 or 6%, with about 3% often being optimum.

The remainder of the monomers used for forming the polymer will be selected having regard to the other properties which are required for the polymer.

The insoluble monomers, which often provide 70 to 99.9%, preferably 85 to 99%, by weight of the monomers, are preferably selected from $C_{1-18}$ alkyl or cycloalkyl esters of acrylic acid or methacrylic acid, acrylonitrile, styrene, vinyl halides, dienes such as butadiene, vinyl esters, such as vinyl acetate or any other insoluble monomers useful for imparting the desired properties to the film. The preferred monomers are $C_{1-4}$ alkyl acrylates and $C_{2-4}$ alkyl methacrylates, most preferably ethyl acrylate, optionally in combination with hydroxyethyl methacrylate and/or glycidyl (meth) acrylate. These water insoluble monomers are usually unreactive, i.e., they do not react during the curing of the binder.

Small amounts, e.g., up to 10% or 20% of unreactive water-soluble monomers, such as acrylamide or methacrylamide, can be used and some carboxylic acid monomers such as acrylic acid or methacrylic acid can be used in small amounts, e.g., up to 5% or 10%, provided it does not interfere with the reactivity with the itaconic acid or other defined dicarboxylic monomer. The amount of water-soluble monomer is usually less than 20%, often less than 10% by weight of total monomers.

The monomers which are used must be free of N-methylol acrylamide or other N-methylol monomer, i.e., a monomer which might liberate measurable amounts of formaldehyde during use. It is often preferred that the dicarboxylic groups should be the only reactive groups in the polymer, in order that these groups only are the groups which react on to hydroxyl groups in the cellulosic or other substrate. However it can be desirable to provide for internal esterification between the dicarboxylic groups and reactive monomer groups within the polymer, especially hydroxyl or epoxide groups. This internal esterification can supplement the fastness of the print paste on to the substrate and, in particular, it can provide fastness when the substrate does not contain an adequate proportion of reactive hydroxyl groups, for instance when the substrate is formed of a different type of fibrous material from cellulosic fibres.

Accordingly, it can be desirable to include hydroxyl containing monomer in the polymer to allow internal esterification between the hydroxyl monomer and the itaconic or other dicarboxylic monomer, in which event a hydroxyalkyl (meth) acrylate may be included. The amount is typically 0 to 20%, usually 0 to 10% by weight of monomers. If this monomer is included, the amount is usually 0.3 to 3 parts, often around 0.5 to 1.5 parts, by weight per part by weight of the itaconic acid or other dicarboxylic monomer. If present, the amount is typically 1 to 6% by weight.

An alternative class of monomers which may be included to react with the anhydride groups is epoxide monomers, such as glycidyl (meth) Acrylates. Epoxides react very readily with anhydrides and may be used for making so-called low energy cure binders, i.e. binders that can be cross-linked at lower temperatures.

The overall blend of monomers will be selected so as to impart the desired physical properties to the final polymer in the composition and after curing, and generally all monomers except the dicarboxylic monomer (and the hydroxyl and/or epoxy monomers if present) are unreactive, that is to say they do not react either in the liquid composition or during normal coating and heating of the composition in use.

When the print paste composition is printed on to the textile substrate and the print is then dried and heated, reaction seems to occur between any reactive hydroxyl groups on the substrate and the dicarboxylic groups (free acid or anhydride) in the polymer, probably as a result of reaction between the hydroxyl groups and anhydride groups which are either initially present in the polymer or, preferably, which are formed as an intermediate as a result of drying and heating of the coating. For instance when the substrate contains cellulosic fibres or, especially, cotton fibres, reactive hydroxyl groups in the fibres appear to react with the polymer so as to give a fast coating.

The polymer is preferably made by oil-in-water emulsion polymerisation and this resultant emulsion is preferably blended into the aqueous print paste.

The aqueous vehicle of the print paste generally includes one or more non-binder polymers. For instance it generally includes a polymeric viscosifier or thickener. The non-binder polymer is not intended to contribute to the binding mechanism to any significant extent so it must, of course, be non-reactive with the curable binder under the conditions that prevail during the printing and cure of the compositions of the invention. Thus it is desirable to avoid the use of viscosifiers or other materials that would react with the curable binder polymer in preference to or at the same time as the desired reaction between the curable binder polymer and the substrate and/or the desired internal esterification of the curable binder polymer.

Thus, in preferred compositions of the invention, any polymeric component additional to the curable binder polymer should be unreactive under the conditions that will prevail during the printing and use and should not enter into reaction with the curable binder polymer. This is because such reaction is likely to influence the final properties of the coating and it is desirable to be able to optimise those by independent selection of the viscosifying polymer and the curable binder polymer, without having to consider interactions between the curable binder polymer and any viscosifying, stabilising or other polymers in the system. For instance if polyvinyl alcohol polymers are included in the system, the dicarboxylic groups are liable to interact with them and this may adversely influence the handle of the final product, as a result of the formation of a rather rigid binder in the print.

Preferably the monomers used for forming the curable polymer consist essentially only of, and usually consist only of, the named monomers, and the polymers in the system consist essentially only of, and generally consist only of, the defined curable polymer and non-binder polymers which will not react with it. Of course trivial amounts of interaction with other monomers or polymers are unimportant if they do not influence the properties, but they are best avoided.

The viscosifying or other non-binder polymer can be any of the non-binder polymers which are conventionally used in print pastes and can be used for the same purposes as are conventional and used in the conventional amounts. A typical viscosifier is a cross-linked reverse phase emulsion of an acrylamide polymer, for instance as sold under the trade name Alcoprint PTF by Allied Colloids. The pigment and its amount can be conventional.

The amount of binder polymer in the paste is typically 1 to 20%, often around 2 to 10%, dry weight polymer based on the total weight of paste.

The print paste composition may be formed by blending the pigment, the aqueous vehicle, the viscosifying or other non-binder polymer and the curable binder polymer all in conventional manner so as to produce a print paste having rheology selected according to the printing technique which is to be used. Accordingly, the composition can be formulated in the conventional manner except for the inclusion of the defined polymer. Thus the composition is normally applied alkaline as a result of the inclusion of ammonia or other volatile base, and this base evaporates after application of the composition to the substrate thereby creating acid conditions.

The print paste may be applied by conventional printing techniques to the selected substrate. This is preferably a substrate containing cellulosic fibres or other fibres containing reactive hydroxyl groups, most preferably a substrate containing cotton fibres, for instance at least 5 or 10% by weight cotton, and often at least 30% by weight cotton.

After printing, the coated substrate is typical heated at a temperature of 100° to 250° C., usually 140° to 200° C. for sufficient time to achieve drying and curing. At the higher temperatures, for instance above 180° C., heating times of about half to 3 minutes can be sufficient but at the lower temperatures longer heating times, for instance 1 to 10 minutes may be required.

When the substrate is a cotton fabric or a cotton blend such as polyester cotton, the coating may be sufficiently fast to the fabric even when the polymer is free of hydroxy groups and no external cross-linker is included in the composition but fastness on cotton can be improved by inclusion of glycidyl monomer and/or hydroxyl monomer in the polymer.

When the substrate is a polyester substrate or other synthetic or other substrate which does not have reactive hydroxyl groups, then it is desirable to include hydroxyl or glycidyl monomer in the polymer so as to improve fastness.

The following are examples.

EXAMPLE 1

106.2 g of water and 0.2 g of Tetralon B were weighed into a 700 ml reaction vessel which was then placed in a water bath and stirred. The reactor was purged with a flow of about 100 ml/minute of nitrogen. Two feeds were made up: Feed 1; 6.0 g of itaconic acid and 7.41 g of Perlankrol ESD (Trade Mark) were dissolved in 153.7 g of water and 194 g of ethyl acrylate was added. The mixture was stirred for five minutes with a Silverson L4R emulsifier to give a white emulsion that was stable for at least 3 hours. Feed 2: 0.8 g of ammonium peroxodisulphate was dissolved in 20 g of water. The water bath was heated to 82° C. and the contents of the reactor were at 80° C. 0.8 g of ammonium peroxodisulphate was dissolved in 16 g of water. This solution was added to the vessel and the two feeds were fed into the reactor at constant rates so that Feed 1 took 3.5 hours and Feed 2 took 3 hours to feed in. The emulsion was stirred for another hour at 80° C. The polymer emulsion was then cooled and poured out through a 50 $\mu$m mesh filter.

A range of other polymers was made by generally the same procedure using varying amounts of ethylacrylate (EA) itaconic acid (IA), methacrylic acid (MAA), hydroxyethyl methacrylate (HEMA), as shown in the Table below. Also, in run 6, the amount is shown as 4.0, to indicate that 4% maleic anhydride was used instead of itaconic acid. This would hydrolyse to maleic acid during the polymerisation.

EXAMPLE 2

Print pastes were formed to the following recipe 8.0 g Imperon Blue KRR (Hoechst), 24.0 g of the polymer emulsion made in Example 1

2.0 g of 0.880 ammonia, 160 g of water and

Alcoprint PTF (trade mark) was added as thickener until the viscosity was 20000±1000 cP measured on a Brookfield RVT viscometer with a No 6 spindle at 10 r.p.m. and at 25° C.

The paste was printed onto cotton polyester fabric through a 40×25 cm 125 $\mu$m mesh screen with a Zimmer laboratory printing machine, using a No. 3 bar.

The print was divided into three parts and dried and fixed for 50 seconds at 175°, 185° and 195° C. in a Benz laboratory stenter.

The result was a blue print.

In some of the tests, 2% of a blocked di-functional isocyanate catalyst was added (cat) to the print paste.

The resultant fabrics were tested for rub fastness and scrubbing fastness. It was consistently found that the fabrics made using itaconic acid in the polymer gave better fastness than the other fabrics, especially in the presence of the catalyst.

In particular, the change of shade after scrubbing was observed after fixing at defined curing temperatures and was assessed on a scale of 1 to 5. 1 is very poor and 5 indicates no change in shade at all. A value such as 4/5 means that the fastness is half way between 4 and 5. 4–4/5 shows a value between 4 and 4/5. The results were as follows:

| | EA | IA | MAA | HEMA | change of shade after scrubbing after fixing at °C. | | |
|---|---|---|---|---|---|---|---|
| | | | | | 175 | 185 | 195 |
| 1 | 98 | | 2 | | 1 | 1 | 1 |
| 2 | 92.7 | | 5.3 | 4.0 | 1 | 1 | 1 |
| 3 | 95 | | 3.0 | | 1 | 1 | 1 |
| 4 | 92.0 | 4.0 | | 4.0 | 2/3–3 | 3– | 3 |
| 5 | 94.0 | 2.0 | | 4.0 | 2/3–3 | 3– | 3 |
| 6 | 94.0 | 4.0* | | 2.0 | 1 | 1 | 1 |
| 7 | 99.0 | 1.0 | | | | | 4 |
| 8 | 98.0 | 2.0 | | | | | 4 |
| 9 | 97.0 | 3.0 | | | | | 4/5 |
| | | | | | 150° C./4 min | | 195° C./50 s |
| 10 | 97.0 | 3.0 | | | 4 | | 4+ |
| 11 | 96.0 | 4.0 | | | 4 | | 4+ |
| 12 | 95.0 | 5.0 | | | 4 | | 4+ |
| 13 | | (10 + cat) | | | 4/5 | | 5– |
| 14 | | (11 + cat) | | | 4/5 | | 5– |
| 15 | | (12 + cat) | | | 4/5 | | 5– |

The results in tests 7 to 15, especially 9 to 15, are about as good as or better than the results obtainable with a methylolacrylamide-based binder which is used commercially at present. Thus the results show that the invention allows adequate or better results than existing commercial products and yet avoids the disadvantage of formaldehyde release during the process or of formaldehyde remaining on the fabric.

I claim:

1. A method of textile printing comprising printing on to a textile substrate a print paste composition comprising a dispersion of pigment in an aqueous vehicle containing unreactive polymeric viscosifier and curable binder polymer, wherein the curable polymer is a curable, water insoluble, polymer which is free of N-methylol groups and which is formed of ethylenically unsaturated monomers which are free of N-methylol groups and which comprise 0.1 to 10% by weight of anhydride-forming dicarboxylic acid and/or dicarboxylic anhydride monomer, 0 to 10% by weight hydroxy alkyl (meth) acrylate, 0 to 10% by weight glycidyl (meth) acrylate, 0 to 20% by weight unreactive water soluble monomer selected from acrylamide, methacrylamide, acrylic acid and methacrylic acid, and 70 to 99.9% by weight unreactive water insoluble monomer selected from alkyl or cycloakyl esters of acrylic acid or methacrylic acid, acrylonitrile, styrene, vinyl halides, dienes and vinyl esters and wherein the monomers include 0.3 to 3 parts by weight (per part by weight of the dicarboxylic monomer) of monomer selected from the group consisting of hydroxy alkyl (meth) acrylate and glycidyl (meth) acrylate and heating the printed substrate to cause internal esterification between the dicarboxylic acid or anhydride groups and hydroxyl or epoxy groups in the curable polymer.

2. A method according to claim 1 in which the amount of dicarboxylic monomer is 1 to 6% by weight.

3. A method according to claim 1 in which the dicarboxylic acid is itaconic acid or anhydride.

4. A method of textile printing comprising printing on to a fabric containing cellulosic fibers a print paste composition comprising a dispersion of pigment in an aqueous vehicle containing unreactive polymeric viscosifier and curable binder polymer, wherein the curable polymer is a curable, water insoluble, polymer which is free of N-methylol groups and which is formed of ethylenically unsaturated monomers which are free of N-methylol groups and which comprise 0.1 to 10% by weight of anhydride-forming dicarboxylic acid and/or dicarboxylic anhydride monomer, 0 to 10% by weight hydroxy alkyl (meth) acrylate, 0 to 10% by weight glycidyl (meth) acrylate, 0 to 20% by weight unreactive water soluble monomer selected from acrylamide, methacrylamide, acrylic acid and methacrylic acid, and 70 to 99.9% by weight unreactive water insoluble monomer selected from alkyl or cycloakyl esters of acrylic acid or methacrylic acid, acrylonitrile, styrene, vinyl halides, dienes and vinyl esters and heating the printed substrate to cause reaction between the dicarboxylic acid or anhydride groups and hydroxyl groups in the cellulosic fibers.

5. A method according to claim 4 in which the curable polymer is formed of 1 to 10% itaconic acid or anhydride or maleic anhydride, 0 to 10% glycidyl (meth) acrylate and 85 to 99% alkyl or cycloalkyl (meth) acrylate.

6. A method according to claim 4 in which the dicarboxylic acid is itaconic acid or anhydride.

7. A method according to claim 4 in which the curable polymer is present as an emulsion in the aqueous vehicle.

8. A method according to claim 4 in which the curable binder polymer is the only curable polymer in the composition and the monomers from which the polymer is formed consist essentially only of the dicarboxylic monomer, the unreactive water insoluble monomer and, optionally, unreactive water soluble monomer, hydroxy alkyl (meth) acrylate and glycidyl (meth) acrylate.

9. A method according to claim 4 in which the dicarboxylic monomer is itaconic acid or anhydride or maleic anhydride.

10. A method according to claim 4 in which the amount of dicarboxylic monomer is 1 to 6% by weight.

11. A method according to claim 4 in which the curable polymer is formed of 1 to 10% itaconic acid or anhydride or maleic anhydride, 0 to 10% hydroxyalkyl (meth) acrylate and 85 to 99% alkyl or cycloalkyl (meth) acrylate.

12. A method according to claim 4 in which the cellulosic fibers are cotton fibers.

* * * * *